US007107724B2

(12) United States Patent
Suprina et al.

(10) Patent No.: US 7,107,724 B2
(45) Date of Patent: Sep. 19, 2006

(54) INTERCHANGEABLE STADIUM SEATING AND ENTERTAINMENT STAGE

(75) Inventors: Scott Suprina, Commack, NY (US); Tony English, Huntington, NY (US)

(73) Assignee: RI, Inc., Hauppauge, NY (US)

( * ) Notice: Subject to any disclaimer, the term of this patent is extended or adjusted under 35 U.S.C. 154(b) by 560 days.

(21) Appl. No.: 10/379,084

(22) Filed: Mar. 4, 2003

(65) Prior Publication Data

US 2003/0177707 A1 Sep. 25, 2003

Related U.S. Application Data

(60) Provisional application No. 60/365,640, filed on Mar. 19, 2002.

(51) Int. Cl.
*E04H 3/12* (2006.01)

(52) U.S. Cl. ..... 52/9; 52/7

(58) Field of Classification Search ..... 52/7, 52/8, 9

See application file for complete search history.

(56) References Cited

U.S. PATENT DOCUMENTS

| | | | | |
|---|---|---|---|---|
| 2,668,331 A | | 2/1954 | Horn | 20/1.123 |
| 3,443,835 A | | 5/1969 | Brunskole | 297/35 |
| 3,808,757 A | | 5/1974 | Greenwood | 52/184 |
| 4,162,594 A | * | 7/1979 | Mackintosh | 52/9 |
| 4,412,403 A | | 11/1983 | LeFranc et al. | 52/9 |
| 4,580,776 A | | 4/1986 | Burkinshaw | 272/3 |
| 4,688,357 A | | 8/1987 | Deaton | 52/9 |
| 4,831,797 A | | 5/1989 | Vladikovic | 52/126.6 |
| 5,385,323 A | | 1/1995 | Garelick | 248/161 |
| 5,794,383 A | * | 8/1998 | Labinski | 52/9 |
| 5,921,032 A | | 7/1999 | Labinski | 52/9 |
| 5,960,589 A | * | 10/1999 | Youngquist et al. | 52/8 |
| 6,000,174 A | * | 12/1999 | Yamazaki | 52/9 |
| 6,029,406 A | | 2/2000 | Staehlin | 52/9 |
| 6,244,657 B1 | | 6/2001 | Momose | 297/217.7 |

* cited by examiner

*Primary Examiner*—Carl D. Friedman
*Assistant Examiner*—Tiara Robertson
(74) *Attorney, Agent, or Firm*—Alfred M. Walker

(57) ABSTRACT

A method and apparatus is used to interchange certain seating areas within a sports stadium or arena with an entertainment stage on a temporary basis to support an alternate use of the facility such as for a religious event, civic gathering, or musical concert. Loss of revenue producing seats for a concert due to poor viewing access is minimized, since none of the remaining seats are blocked from viewing the entertainment stage. The seating sections are provided in self-supporting modules or risers of approximately one hundred seats (or equivalent bench seating area). The seating sections are moved with the aid of a mobile crane and specially designed trailers. These seating sections are stored on elevated landing racks located outside of the stadium. Entertainment stage sections with equivalent "footprint" configurations are stored on these same landing racks when they are not in use in the stadium.

27 Claims, 12 Drawing Sheets

INTERCHANGEABLE STADIUM SEATING AND ENTERTAINMENT STAGE

RELATED APPLICATIONS

This application claims the benefit, under 35 U.S.C. §119 (e) of U.S. Provisional Application No. 60/365,640 filed Mar. 19, 2002.

FIELD OF THE INVENTION

The present invention relates to quickly removable and relocatable stadium seating for sporting and live entertainment events, such as musical concerts or oratory expositions.

BACKGROUND OF THE INVENTION

Often sports stadiums are used for entertainment stages for music concerts or other live entertainment events. In such a case, a temporary entertainment stage is erected directly on the playing field of the sports stadium. However, a significant portion of the seating revenue is lost, because the stage stands in front of a number of seats of the stadium.

For example, in a football type of stadium, generally in an oval configuration, most of the seats in one of the end zones behind the goal posts are lost, since they face the rear of the entertainment stage. Likewise, in a generally diamond-shaped baseball stadium, if the entertainment stage is positioned between the pitcher's mound and the home plate area, all of the seats in what is considered "foul territory" behind home plate are unusable, since they also face the rear of the temporary entertainment stage. Furthermore, in an indoor basketball arena, such as Madison Square Garden in New York City, the temporary stage is set up in front of one of the end zones of seating sections behind one of the baskets.

This results in a significant loss of revenue to the concert promoters or the stadium management, since they cannot sell tickets in areas of the stadium seating where a view of the entertainment stage is blocked.

The positioning of the stage on a portion of a conventional athletic playing field is unavoidable, since the stadium seats cannot be moved.

This temporary positioning of the entertainment stage in a sports stadium is in contrast to permanent entertainment stages in indoor theaters, where the stage is recessed into one wall, and the viewing takes place along the entire perimeter of the inside of the theater, even including "side orchestra level" or "side balcony seats" with an angled, but viewable, view of the stage from the side.

Attempts have been made to rearrange whole sections of seats within a sports stadium, but not to accommodate the temporary replacement of the seats with an entertainment stage in their place.

For example, among prior art efforts in movable stadium seating modules include U.S. Pat. No. 6,029,406 of Staelin which describes in-fill stadium seating sections which can be temporarily moved back to accommodate handicap wheelchairs in place thereof.

The seating sections of Staelin '406 may remain unconnected to a stadium wall. However, the seats of Staelin '406 replace a small module of a small number of seats, with a couple of wheel chairs as desired. Such a small number of seats is not an efficient size for removing large numbers of seats. The extra effort of folding down the seats of Staelin '406 grants no advantage to moving large number of seats. To attempt to move the limited number of seats as in Staelin '406 as a rigid module in the open position would probably cause early wear and failure due to the foldable construction described in Staelin '406.

U.S. Pat. No. 4,688,357 of Deaton describes a stadium with movable modules of seats to change the playing field from a square baseball diamond shape to an oblong football field and vice versa. The seating modules are moved on rubber bladder pads. However, the seating section of Deaton '357 is a very large module of about 10,000 seat capacity. It is much too large to handle with a crane and trailer. To store off site, one would need a flat smooth hard floor and direct open access to a parking lot, to use the leaky rubber bladder pads of Deaton '357.

U.S. Pat. Nos. 5,921,032 and 5,7494,383, both of Labinski, describe connectable stadium seating systems. Both of the Labinski '032 and '383 patents are heavily into structure, stadium design, and sub-structure definition and are very light on details of how to move seating sections. In Labinski '383, it is obvious that sections are to be moved within the stadium, sometimes transversing the playing field. The lift or jack means mentioned are not incorporated into a mobile trailer.

Moreover, U.S. Pat. No. 2,668,331 of Horn and U.S. Pat. No. 4,580,776 of Burkinshaw describe collapsible entertainment stages in general. Moreover, Applicants Scott Suprina and Tony English have a pending application Ser. No. 09/710,470 filed Nov. 9, 2000 for "Demountable Indoor/Outdoor Seating Systems Components" which describes fasteners for stadium seating seats and floor board decks, as well as guard rails and hand rails for stadium seating modules. That application including its text and drawing is incorporated by reference herein.

None of the prior art details methods of interchangeable movement of stadium seat sections or stage sections to and from a portable storage area outside, and in the vicinity of, an arena or stadium.

OBJECTS OF THE INVENTION

It is therefore an object of the present invention to minimize the loss of revenue producing seats for a concert due to poor viewing access, wherein in the more typical situation the entertainment stage is set up on the playing field, negating the use of seats behind the stage.

It is also an object of the present invention to provide a method for rapidly and interchangeably moving stadium seating sections and an entertainment stage alternately to and from inside of a stadium to an exterior temporary storage site outside of the stadium.

It is also an object of the present invention to allow removable seating to be used in other locations on site.

It is yet another object of the present invention to maximize viewing areas of an entertainment stage within a stadium arena, without losing revenue producing seats.

It is also an object to overcome the disadvantages of the prior art.

SUMMARY OF THE INVENTION

In keeping with these objects and others which may become apparent, this invention relates to a method and apparatus to quickly interchange certain removable and relocatable seating areas within a sports stadium or arena with an entertainment stage or seating for alternate sports events on a temporary basis, to support an alternate use of the facility, such as for a religious event, civic gathering, or musical concert. This is done in an efficient manner without disturbing the playing field. The method can be used in open stadiums or in stadiums with high ceilings and open or removable outer wall sections.

The system of the present invention works well because the individual stadium seats remained fastened to the seat support decks while they are moved together. The stadium seating sections comprised of seats and support decks are quickly removable and relocatable so that the stadium seating can be configured with a minimum of labor cost and time expended during reconfiguration of the stadium seating. The stadium seating modules utilize our fasteners for stadium seating seats and floor boards, as well as our guard rails and hand rails, as described in our pending application filed under Ser. No. 09/710,470 on Nov. 9, 2000. As a result, the seating module subframes can be installed up and taken down quickly.

The main objective of this invention is to minimize the loss of revenue producing seats for a concert due to poor viewing access in the typical situation where the stage is set up on the playing field, blocking the view of a significant percentage of the stadium seats behind the stage.

In the present invention, seating sections are provided in self-supporting modules or risers of approximately one hundred seats (or an equivalent bench seating area). These seating sections are handled as a unit and moved with the aid of a mobile crane and specially designed trailers. These seating sections are then stored on a series of elevated landing racks located outside of the stadium, which are exactly spaced to receive them when not in use. Ideally these landing racks are placed adjacent to the stadium, such as in a remote area of the stadium parking lot. The seating sections can be designed to be relocated and used for extra seating for differing events.

Entertainment stage sections with equivalent "footprint" configurations are stored on these same landing racks when they are not in use in the stadium.

The landing racks are elevated to facilitate mechanized loading and unloading from the trailers, which each have a lifting rack platform that rises and lowers vertically. In this manner, one or more designated sections of seating in a stadium can be interchanged with an entertainment stage (or vice-versa) by a small crew with specialized equipment within one day.

Several potential stage areas can be designated. For example, one section of infield sideline seating and one section of infield end zone seating can be configured. In this way, either area can be used for the stage as desired for a particular venue. The only requirement is that the seating for these designated areas be of the modular riser type, which is compatible with the interchange equipment of the present invention.

With the present invention, the user can match existing stadium risers, and can run and coordinate and match vertical aisle locations to comply with existing municipal codes regulating stadium seating.

BRIEF DESCRIPTION OF THE DRAWINGS

The present invention can best be understood in connection with the accompanying drawings, in which.

DETAILED DESCRIPTION OF THE DRAWINGS

Figure 1:
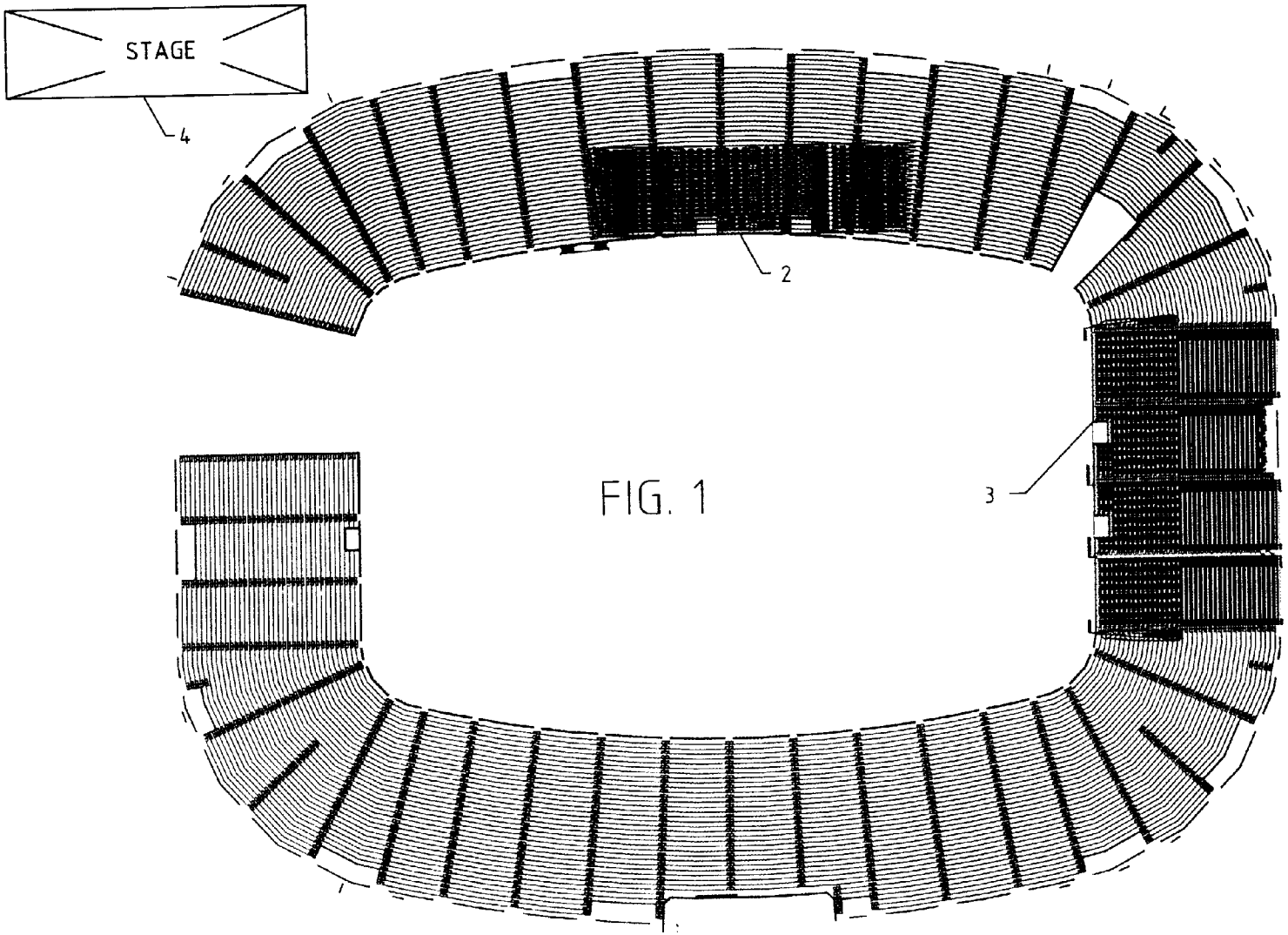
FIG. 1 is a top plan view of a stadium with an entertainment stage in storage and two designated interchangeable seating areas.

FIG. 1 shows a top view of a stadium 1 with interchangeable seat sections 2 and 3 of this invention. Seat section 2 on the infield edge at the sidelines and seat section 3 at the infield end zone are areas of seating made up of modular riser sections. The stage 4 is shown in the storage area outside of the stadium 1.

Figure 2:
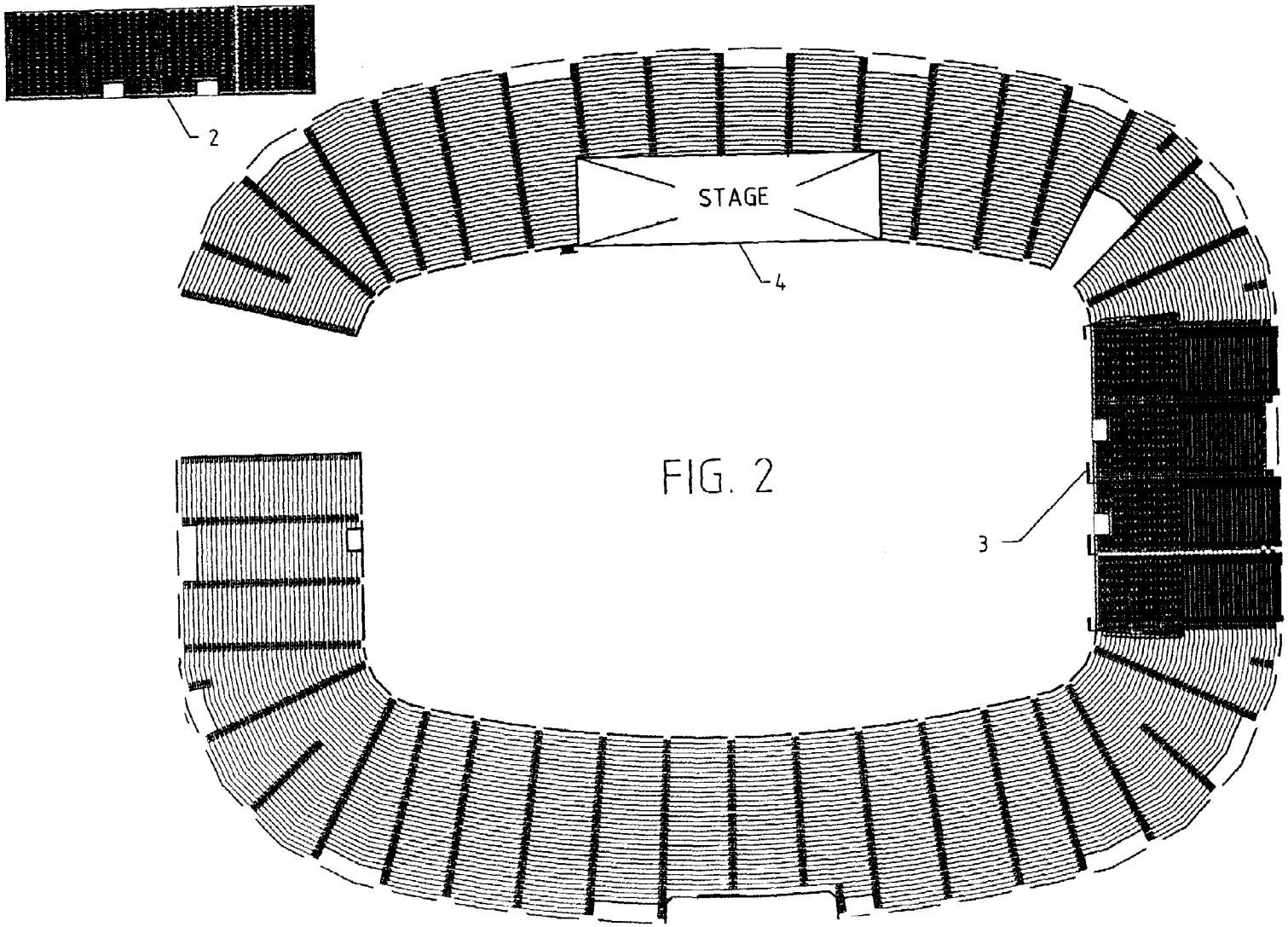
FIG. 2 is a top plan view of the stadium with the entertainment stage installed in sideline location and sideline seats provided in storage.

FIG. 2 shows the same scene except that the entertainment stage 4 has been substituted for the sideline area of seating 2 which is now seen in the storage area.

Figure 3:
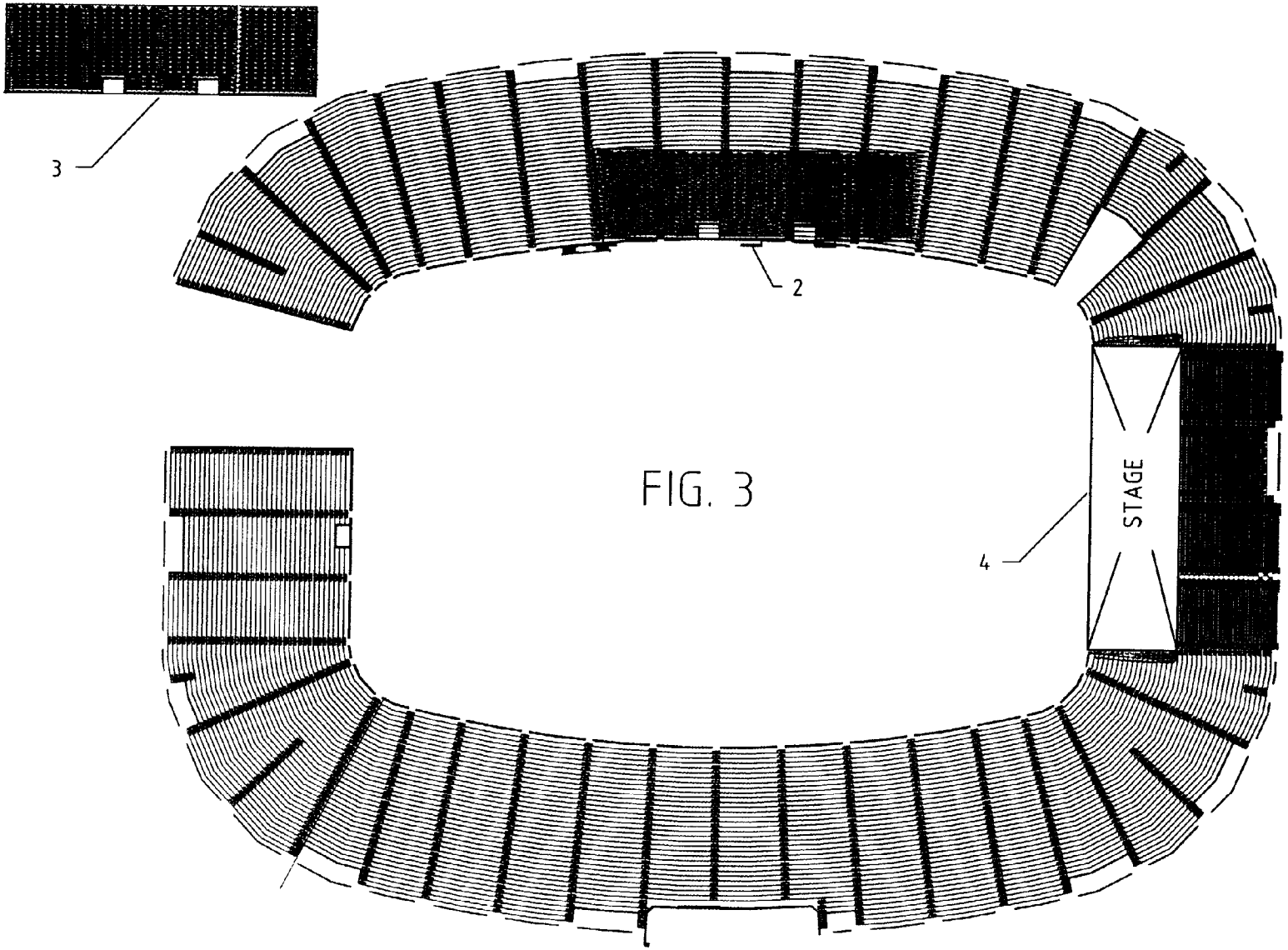
FIG. 3 is a top plan view of the stadium with the entertainment stage installed in an end zone location and end zone seats shown in storage outside of the stadium on temporary storage platforms.

FIG. 3 again shows the same scene except that entertainment stage 4 has now replaced the end zone seating section which has now been moved to the storage area.

Figure 4:
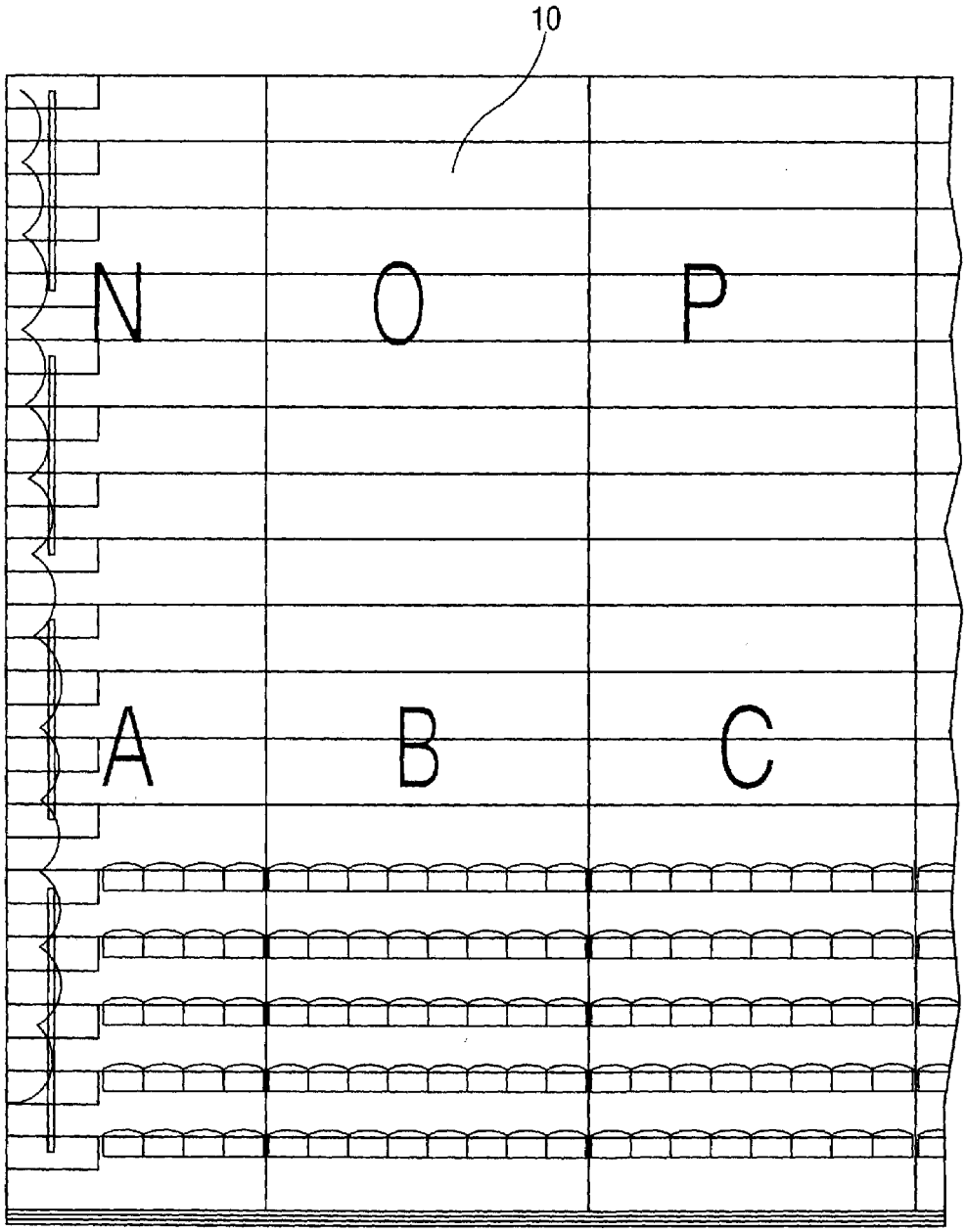
FIG. 4 is a top plan view of an area of interchangeable seating showing modular riser sections which are handled as a unit.

FIG. 4 shows a top view of a detail of interchangeable seating with rectangular demarcations designated as "N", "O", "P", "A", "B", "C" etc., each with approximately 60–120 seat capacity representing a modular riser section which is lifted as a single unit.

Figure 5:
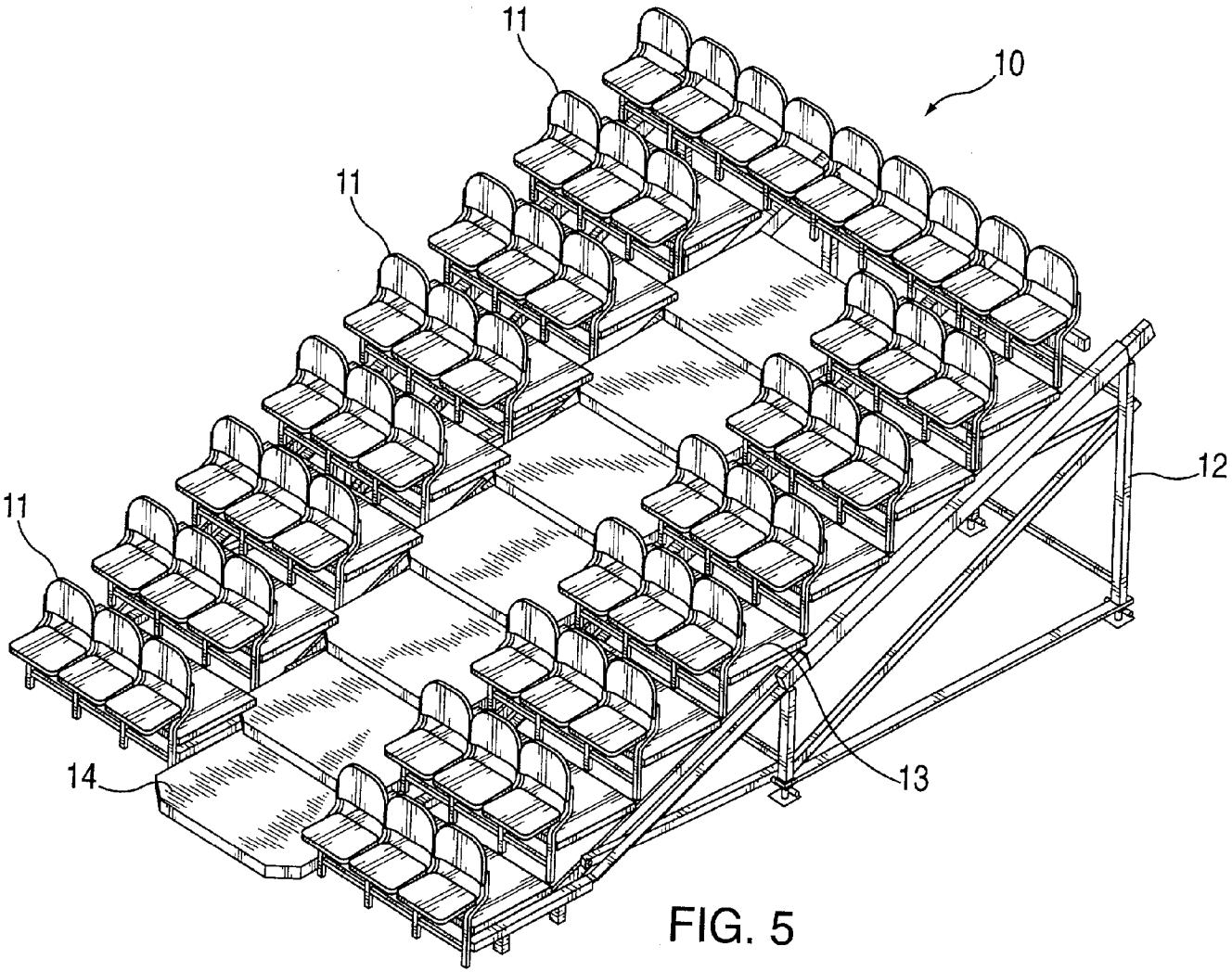
FIG. 5 is a perspective view of a modular riser section thereof.

FIG. 5 shows such a modular riser section 10 with frame 12, seats 11, riser plates 13 and deck steps 14. The number of seats in a modular section can vary. For example, FIG. 5 shows an illustrative example of a modular riser section with eight rows of nine seats across, for a total of seventy two seats.

Figure 6:
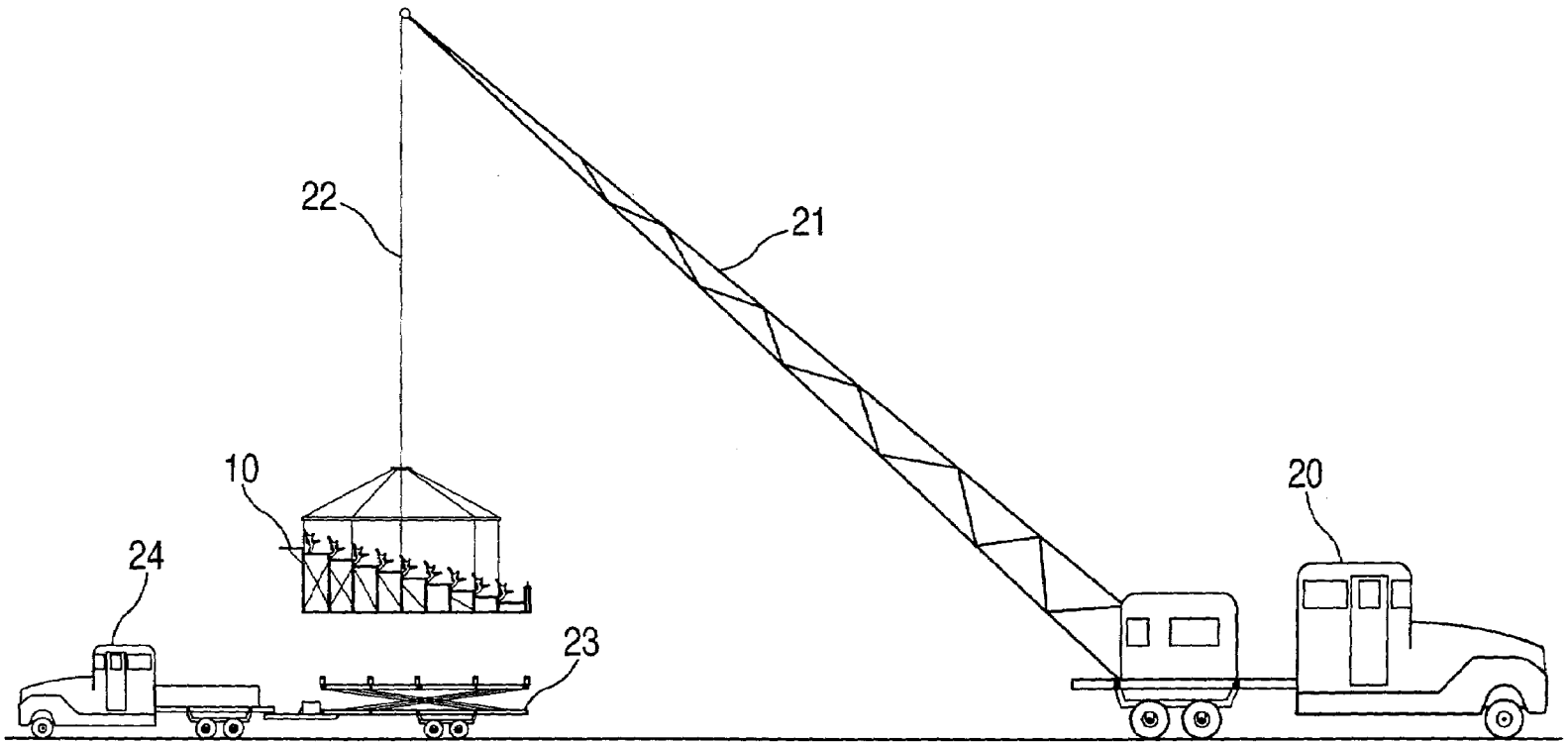
FIG. 6 is a side elevational view of the loading method of the present invention showing a crane and a trailer with a seating module stored thereon.

FIG. 6 is a side view of the method used for loading a riser section 10 (or stage section 4) onto (or from) trailer 23 using a mobile crane 20 with adjustable boom 21 and cable 22. Tow vehicle 24 transports sections of riser seating 10 and stage 4 to and from the storage area to the intended area in the stadium.

Figure 7:
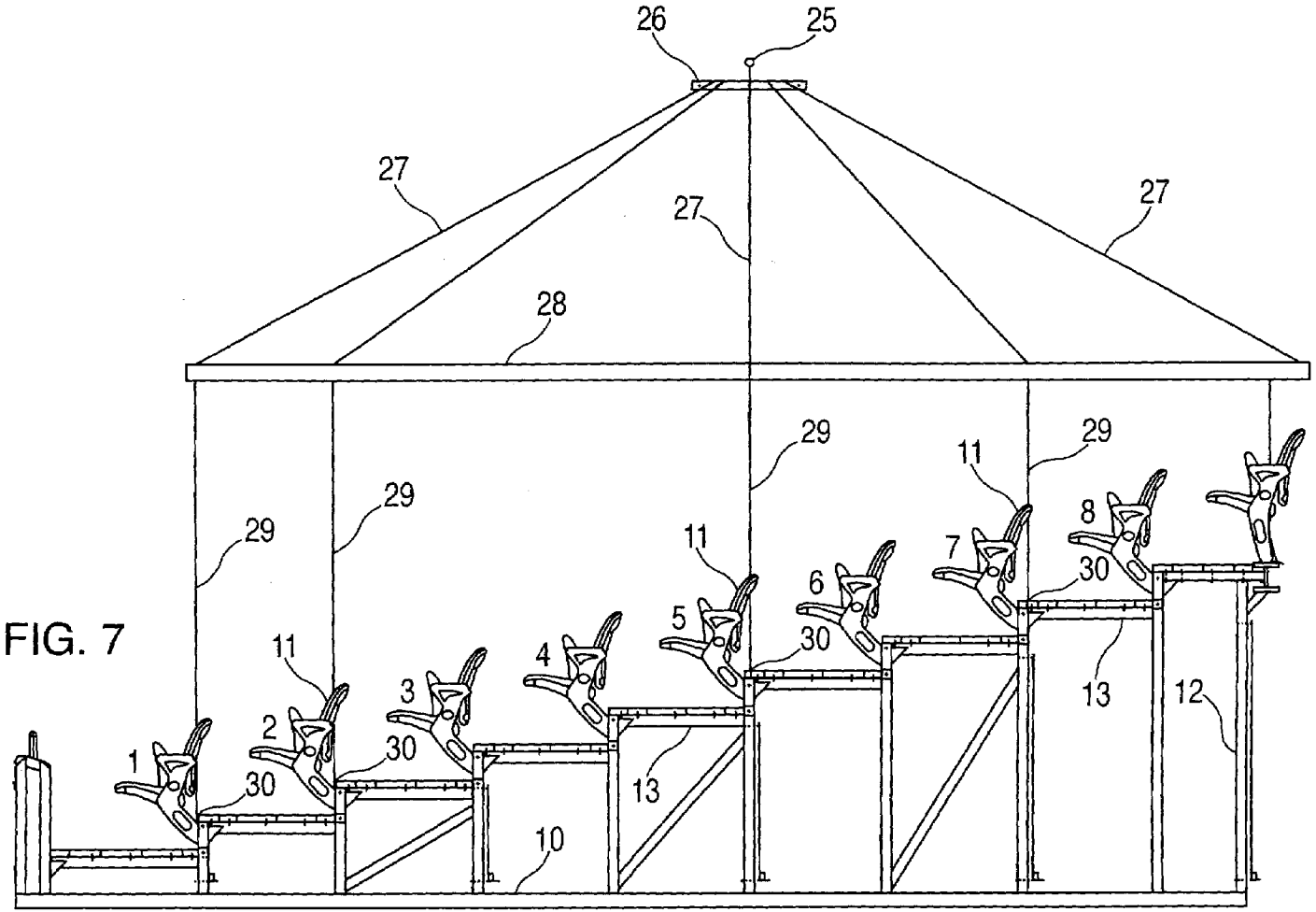
FIG. 7 is a right side elevational view detail of a modular riser section suspended by a crane cable during transport to a storage site.

FIG. 7 is a close-up of modular seating riser section 10 being lifted by crane 20. Crane cable 22 is attached to cable loop 25 which supports lifting ring 26 to which multiple equalizer cables 27 are attached. Variable length vertical lifting cables 29 attach rigid crane lifting rack 28 to frame 12 of seating module 10 via attachment hooks 30. This arrangement insures horizontal transport of seating module 10.

Figure 7A:
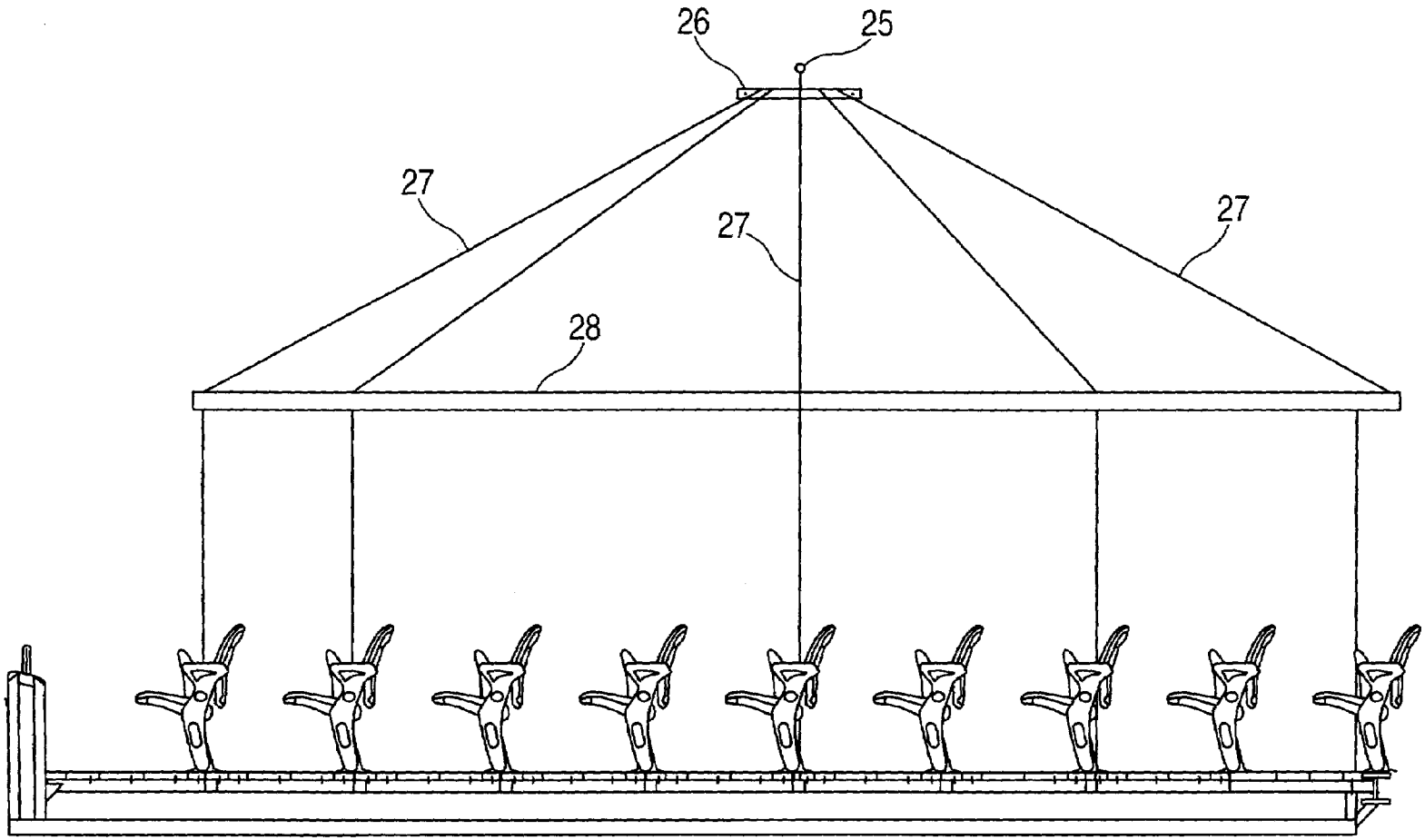
FIG. 7A is a right side elevation view detail of a module riser section of FIG. 7 reconfigured for a low transport height.

With the quick knockdown subframe capability, a seating module can be reconfigured to allow transport height to be reduced. This is illustrated in FIG. 7A. This same feature can also be used to modify elevated seating from one location to be used as non-elevated seating in another part of the stadium.

Figure 8:
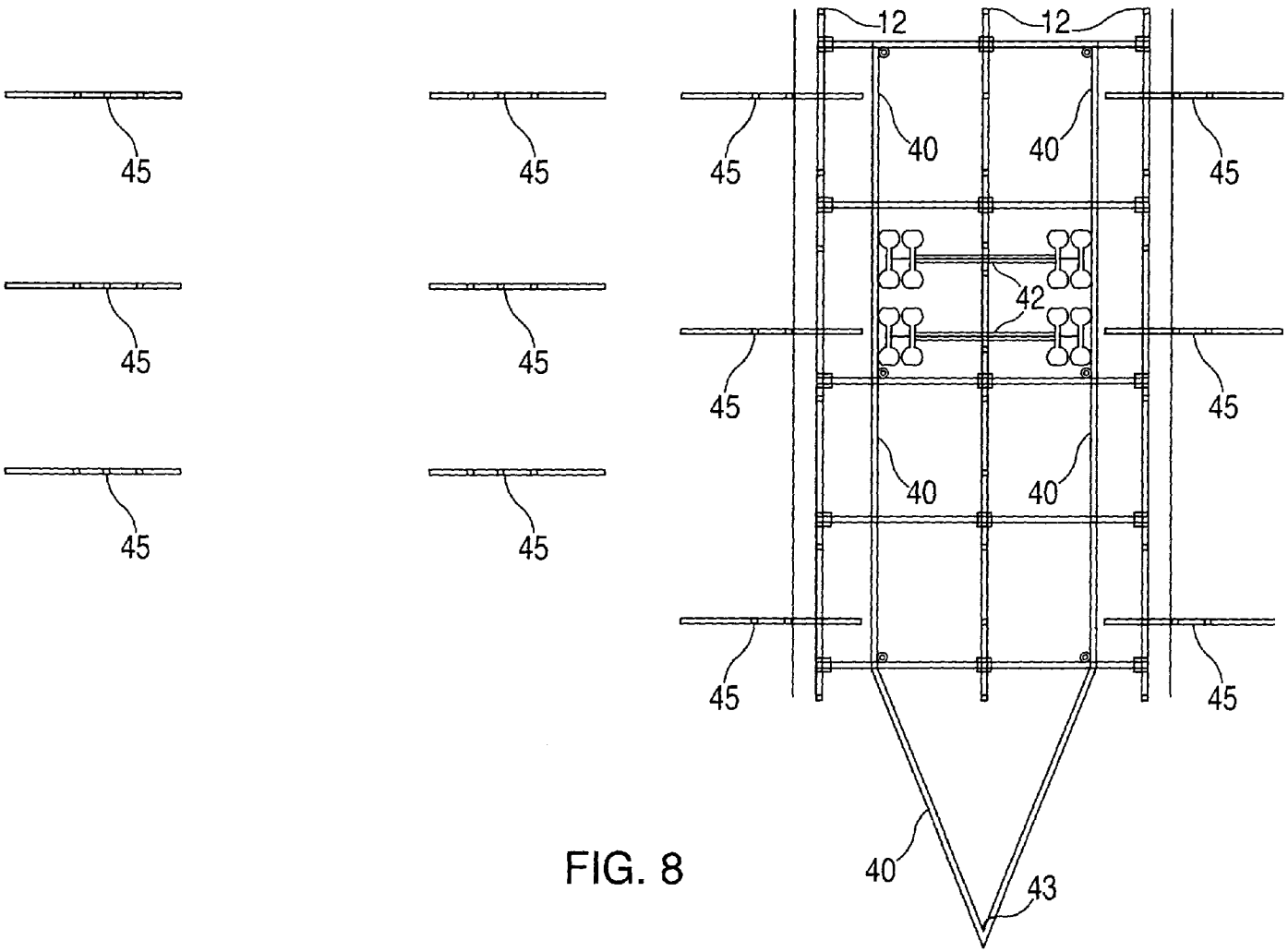
FIG. 8 is a top plan view of the trailer and landing racks of the storage site.

FIG. 8 is a top view of a storage area 49 and trailer 23. Rows of raised landing racks 45 are spaced so as to accommodate sections of seating modules 10 as well as sections of entertainment stage 4 which have a common "footprint".

Trailer 23 fits between two rows of landing racks with frame 40 between the rows such that riser section main rails 12 (i.e., the bottom part of riser frame 12) rests on the top surface of raised landing racks 45. Trailer 23 is shown with dual wheeled axles 42 and trailer hitch 43.

Figures 9, 10:
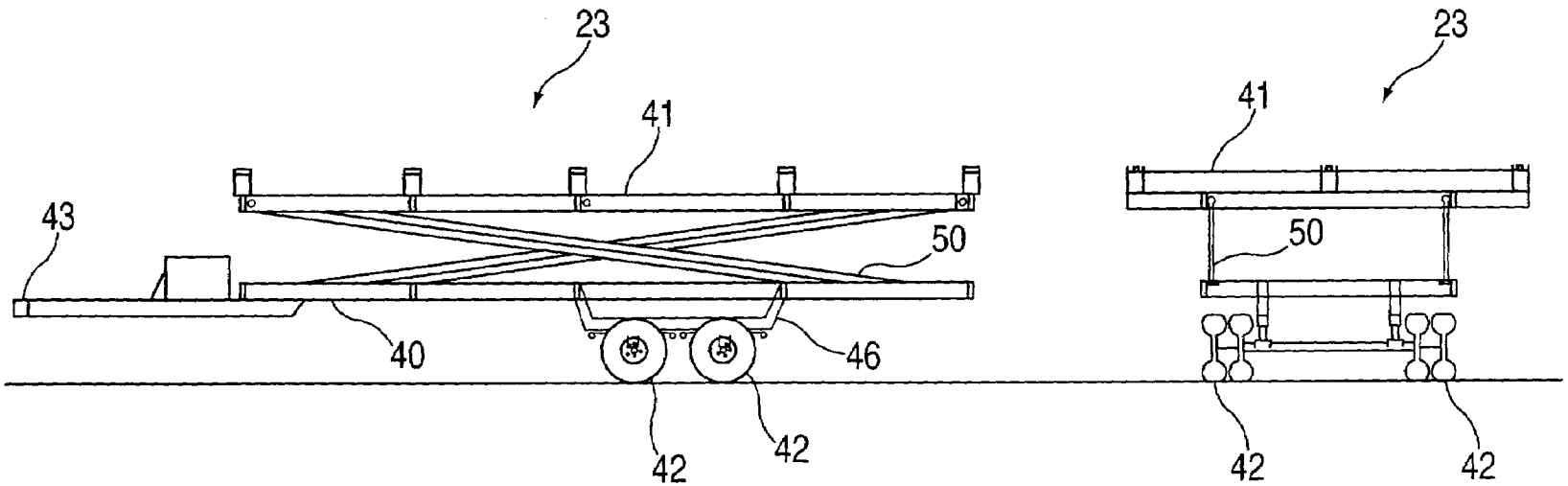
FIG. 9 is a side elevational view of the storage trailer of this invention.
FIG. 10 is an end view of the storage trailer thereof.

In the side view of FIG. 9 and the end view of FIG. 10, more details of trailer 23 are shown. Trailer lifting rack 41 is the top support interfacing with riser frame 12 or its counterpart section of entertainment stage 4. Trailer lifting rack 41 is raised or lowered vertically by lift mechanism 50 which is either a hydraulically or electrically operated lift. Axles 42 (with wheels) are part of suspension truck subassembly 46.

Trailer 23 is designed such that the frame spreads wide for use in and around a stadium to transfer stage and seating sections. It then telescopes inward for empty transport so that it fits within normal road lanes.

Figure 11:
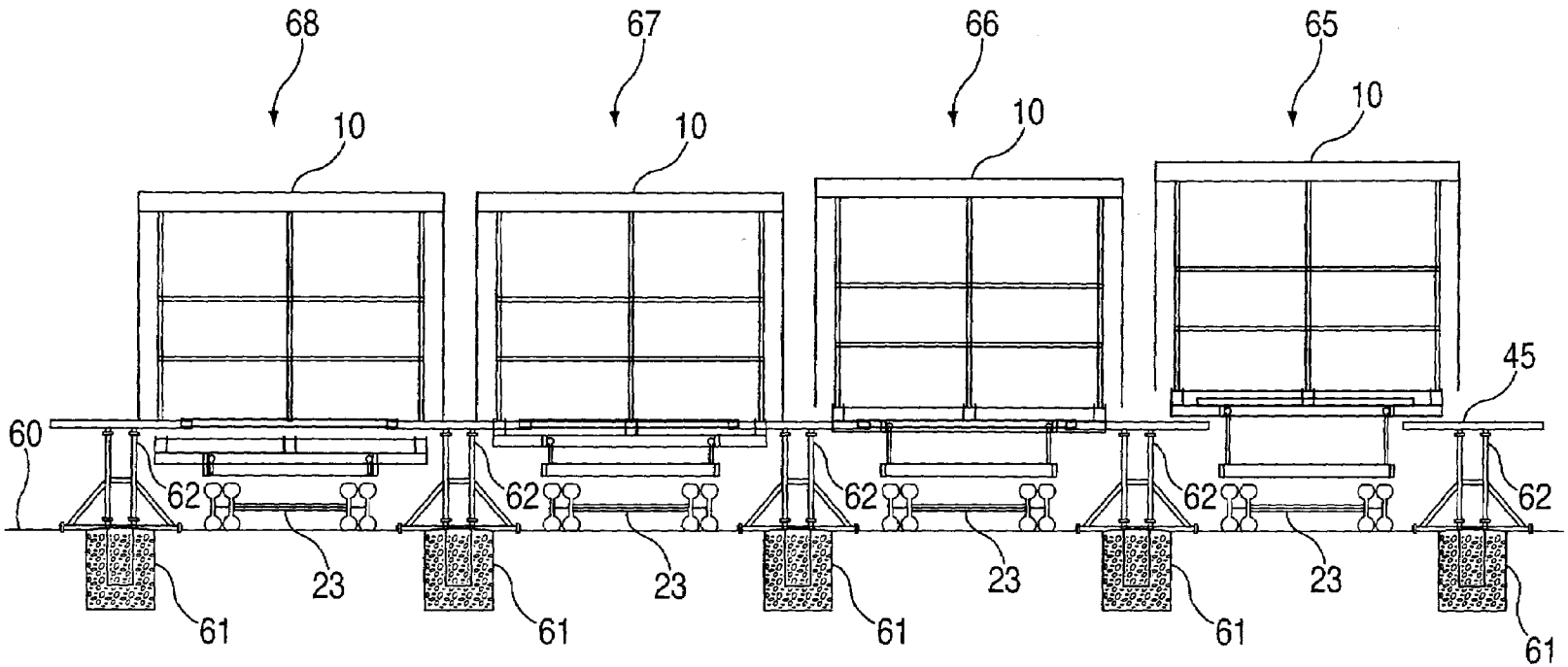
FIG. 11 is an end view of four adjacent landing rack storage areas illustrating four different phases of lifter rack positions, showing an embodiment with below ground supports.

FIG. 11 is an end view of storage area 49 showing four adjacent storage stations 65, 66, 67, 68 illustrating the four phases of transferring a seating module 10 either onto (right to left sequence) or off raised stationary landing racks 45 (left to right sequence). Stationary landing racks 45 are supported by one or more upright columns 62 which are attached to one or more pilings 61 (below grade level 60).

Figure 12:
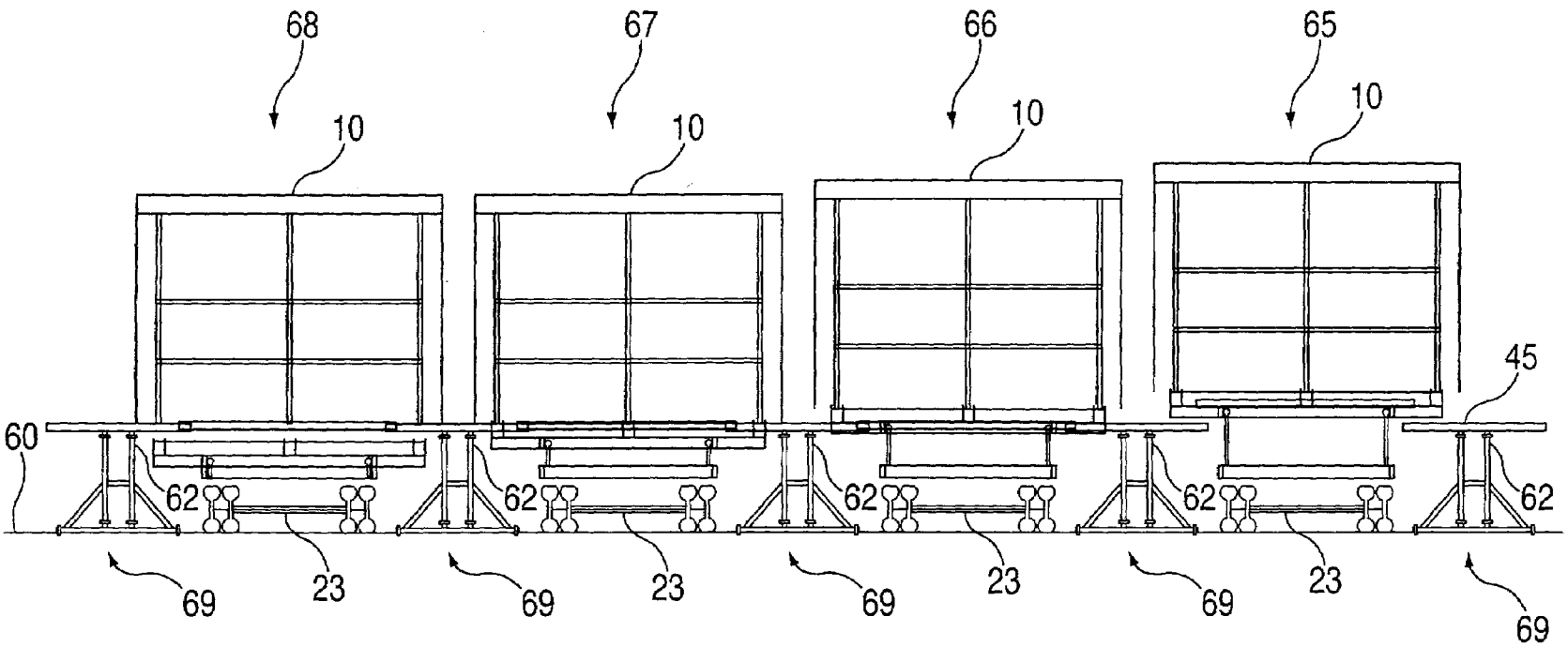
FIG. 12 is an end view of four adjacent landing rack storage areas also illustrating four different phases of lifter rack positions, showing an alternate embodiment with above ground base supports.

FIG. 12 shows an alternate embodiment for movable above ground storage base supports 69 for upright columns 62, without below ground pilings 61.

In both FIGS. 11 and 12, the four phases of transferring seating module 10 onto or off stationary landing racks 45. For example, in the leftmost position, trailer 23 is fully lowered and no longer in contact with module 10, and can therefore be withdrawn (or inserted). In the next position to the right, trailer 23 is raised so as to just contact module 10. In the further position to the right, trailer 23 is raised further so that weight of module 10 is transferred from stationary landing racks 45 to trailer 23. In the rightmost rack position, trailer 23 is fully extended vertically to provide clearance lifting module 10 clear of stationary landing racks 45 for entering (or leaving) this storage position. It is understood that entertainment stage sections 4 can be depicted as substitutes for the depictions of seating modules 10.

It is further noted that various modifications may be made to the present invention, within the scope of the invention, as noted in the appended claims.

We claim:

1. A method of interchanging certain seating areas within a sports stadium arena with an entertainment stage on a temporary basis to support an alternate use of the stadium arena for one of a religious event, civic gathering, and musical concert, without disturbing the sports playing field therein comprising the steps of:

providing a plurality of seating sections in said sports stadium arena in self-supporting riser modules of a plurality of seats;

providing a plurality of corresponding entertainment stage sections, each said entertainment section having a footprint configuration equivalent to a respective seating section module;

moving said seating section modules on respective trailers out of the stadium;

storing said seating section modules on a series of elevated landing racks located adjacent to the stadium;

replacing said seating module sections with said respective plurality of entertainment stage sections previously stored on said elevated landing racks prior to use thereof in the stadium.

2. The method of interchanging certain seating areas within a sports stadium with an entertainment stage as in claim 1 wherein said landing racks are elevated to facilitate alternate, mechanized loading and unloading of said respective seating section modules and said entertainment stage entertainment stage sections from said trailers, said trailers each having a lifting rack platform that rises and lowers vertically for alternate loading and unloading of said seating section modules and said entertainment stage sections onto and from said elevated landing racks.

3. The method of interchanging certain seating areas within a sports stadium with an entertainment stage as in claim 2 further comprising the step of designating each said seating section module as one of an infield sideline seating module and an end zone seating module.

4. The method of interchanging certain seating areas within a sports stadium arena with an entertainment stage as in claim 3 further comprising the step of dividing said seating section modules into a plurality of separable frames of ascending seats, riser plates and deck steps, each said separable riser frame being sized to fit over and overlap a supporting trailer underneath said separable riser frame, wherein further each said seating section module riser is lifted as a single unit onto a respective trailer.

5. The method of interchanging certain seating areas within a sports stadium arena with an entertainment stage as in claim 4 further comprising the steps of alternately loading and unloading each said riser frame onto and from each respective trailer using a mobile crane with an adjustable boom and a support cable tow transporting said riser frames of said seating section modules and said entertainment stage sections to and from said storage area adjacent to said sports stadium arena.

6. The method of interchanging certain seating area within a sports stadium arena with an entertainment stage as in claim 4 further comprising the step of dividing said entertainment stage into discrete partial stage sections bearing a similar size footprint configuration of each said separable seating section module, each said discrete partial stage section being sized to fit over and overlap a supporting trailer underneath said separable partial stage section, wherein further a bottom part of each said separable partial stage section is sized to rest on a top support surface of each said respective raised landing rack.

7. The method of interchanging certain seating areas within a sports stadium arena with an entertainment stage as in claim 4 wherein each said riser frame includes a plurality of knockdownable subframes reducing a predetermined height of each said riser frame of each said seating module to a lower predetermined reconfigured reduced height for transport.

8. The method of interchanging certain seating areas within a sports stadium arena with an entertainment stage as in claim 5, further comprising the step of attaching said crane cable to a cable link supporting multiple equalizer cables supporting a rigid lifting rack suspending a plurality of variable length vertical lifting cables attaching said rigid crane lifting rack alternately to each respective frame of each said seating section module and each entertainment stage section via attachments and horizontally transporting each said seating section module.

9. The method of interchanging certain seating areas within a sports stadium arena with an entertainment stage as in claim 5 wherein each of said trailer lifting racks is alternatively raised and lowered vertically by a lift mechanism.

10. The method of interchanging certain seating areas within a sports stadium arena with an entertainment stage as in claim 5 further comprising the steps of:

transferring each said seating section module and each said stage section either onto said respective adjacent pairs of raised landing racks, each said landing rack being supported by at least one column, lowering each said trailer until each said trailer is fully lowered and no longer in contact with one of each respective seating section module and each respective entertainment stage section, withdrawing each said trailer from below one of each said respective seating section module and each said entertainment stage section.

11. The method of interchanging certain seating areas within a sports stadium arena with an entertainment stage as in claim 6 further comprising the step of raising each said trailer lifting rack so as to alternately contact each said seating section module and each said entertainment stage section.

12. The method of interchanging certain seating areas within a sports stadium arena with an entertainment stage as in claim 6 further comprising the step of alternately raising each said seating section module and each said entertainment stage section from each respective trailer lifting rack of each said trailer extending vertically in a fully extended vertical position providing clearance for lifting each said seating section module and each said entertainment stage section clear of said respective pairs landing racks for one of entering and leaving said stored position outside of said stadium.

13. The method of interchanging certain seating areas within a sports stadium arena with an entertainment stage as in claim 8 further comprising the step of spacing and positioning said raised landing racks in rows to accommodate of said seating section modules and said entertainment stage sections.

14. The method of interchanging certain seating areas within a sports stadium arena with an entertainment stage as in claim 9 wherein said trailer lifting rack is raised hydraulically.

15. The method of interchanging certain seating areas within a sports stadium arena with an entertainment stage as in claim 9 wherein said trailer lifting rack is raised electrically.

16. The method of interchanging certain seating areas within a sports stadium arena with an entertainment stage as in claim 10 wherein each said trailer spreads out wide for picking up each said seating section module and telescopes inward for empty transport of each said trailer.

17. The method of interchanging certain seating areas within a sports stadium arena with an entertainment stage as in claim 13 further comprising the step of inserting each said trailer between adjacent landing racks such that a bottom part of each said riser frame is sized to also rest on top surface of respective adjacent pairs of raised landing racks located adjacent to said stadium arena.

18. A system for interchanging certain seating areas within a sports stadium arena with an entertainment stage on a temporary basis to support an alternate use of the facility such as for a religious event, civic gathering, or musical concert, without disturbing the playing field, said system comprising:

a plurality of seating sections in self-supporting riser modules of a plurality of seats;

a respective plurality of entertainment stage sections having equivalent footprint area as said seating section modules;

at least one movable trailer having a liftable trailer lifting rack platform that rises and lowers vertically for alternate loading and unloading of said seating section modules and said entertainment stage sections onto and from said elevated landing racks out of the stadium arena;

a mobile crane with an adjustable boom and a support cable tow transporting said riser sections of seating sections and stage to and from said storage area adjacent to said stadium; and, a plurality of pairs of stationary storage landing racks each having respective top support surfaces alternately accommodating said seating section modules and said entertainment stage sections in a designated storage area outside of the stadium arena.

19. The system as in claim 18 wherein each said seating section module comprises a separable frame of ascending seats, riser plates and deck steps, and wherein each said entertainment stage section comprises a separable stage frame, said separable riser frame and said separable stage frame being sized to alternately fit over and overlap said pairs of stationary landing racks.

20. The system as in claim 18 wherein said crane further comprises a crane cable supporting a cable link descending therefrom, said cable link supporting multiple equalizer cables supporting a rigid lifting rack suspending a plurality of variable length vertical lifting cables alternately attaching said rigid lifting rack of each respective frame of each said seating module and each respective frame of each entertainment section frame via attachments and horizontally transporting each said seating module.

21. The system as in claim 18 wherein said trailer lifting rack is raised hydraulically.

22. The system as in claim 18 wherein said trailer lifting rack is raised electrically.

23. The system as in claim 18 wherein said stationary landing racks are supported by columns.

24. The system as in claim 18 wherein said trailer lifting rack has a first lowered position not in contact with each respective seating section module and each respective entertainment stage section, and a second raised position in contact with each respective seating section module and each respective entertainment stage section, wherein further each respective trailer lifting rack is extendable vertically to a fully extended vertical position alternately providing clearance lifting each said seating section module and each said entertainment stage section clear of said trailer lifting racks for one of entering and leaving said stored position outside of said stadium.

25. The system of interchanging certain seating areas within a sports stadium arena with an entertainment stage as in claim 18 wherein each said trailer spreads out wide for picking up each said seating section module and telescopes inward for empty transport of each said trailer.

26. The system of interchanging certain seating areas within a sports stadium arena with an entertainment stage as in claim 18 wherein each said riser frame includes a plurality of knockdownable subframes reducing a predetermined height of each said riser frame of each said seating module to a lower predetermined reconfigured reduced height for transport.

27. The system as in claim 20 wherein respective bottom parts of said riser frames and said entertainment stage section frames are sized to also rest on respective top surfaces of respective raised landing racks located adjacent to said stadium.

* * * * *